US006885934B1

(12) United States Patent
Bochum

(10) Patent No.: US 6,885,934 B1
(45) Date of Patent: Apr. 26, 2005

(54) METHOD AND SYSTEM FOR DETERMINING CAMSHAFT POSITION

(75) Inventor: Hansjoerg Bochum, Novi, MI (US)

(73) Assignee: Robert Bosch Corporation, Broadview, IL (US)

( * ) Notice: Subject to any disclaimer, the term of this patent is extended or adjusted under 35 U.S.C. 154(b) by 12 days.

(21) Appl. No.: 10/690,754

(22) Filed: Oct. 22, 2003

(51) Int. Cl.[7] ..... F01L 1/34
(52) U.S. Cl. ..... 701/114; 123/90.15
(58) Field of Search ..... 701/114, 102; 123/90.15, 90.16, 90.17, 90.27, 90.31

(56) References Cited

U.S. PATENT DOCUMENTS

| | | | | |
|---|---|---|---|---|
| 5,115,396 | A | 5/1992 | Keegan | |
| 5,289,805 | A | 3/1994 | Quinn, Jr. et al. | |
| 5,333,577 | A | 8/1994 | Shinojima | |
| 5,363,817 | A * | 11/1994 | Ikeda et al. | 123/90.15 |
| 5,469,818 | A | 11/1995 | Yoshioka et al. | |
| 5,694,912 | A | 12/1997 | Gotou et al. | |
| 6,079,381 | A | 6/2000 | Morikawa | |
| 6,216,655 | B1 | 4/2001 | Yoshiki et al. | |
| 6,488,008 | B1 | 12/2002 | Jankovic et al. | |
| 6,520,131 | B1 | 2/2003 | Takahashi et al. | |
| 6,675,752 | B1 * | 1/2004 | Kunne et al. | 123/90.17 |
| 2002/0029757 | A1 | 3/2002 | Ogawa et al. | |
| 2002/0108593 | A1 | 8/2002 | Hoshino et al. | |
| 2002/0174841 | A1 | 11/2002 | Ashida | |
| 2002/0179027 | A1 | 12/2002 | Jankovic et al. | |
| 2003/0041823 | A1 | 3/2003 | Takemura et al. | |
| 2003/0075148 | A1 | 4/2003 | Hirakata et al. | |
| 2003/0079701 | A1 | 5/2003 | Riedle et al. | |

* cited by examiner

*Primary Examiner*—Hieu T. Vo
(74) *Attorney, Agent, or Firm*—Michael Best & Friedrich LLP

(57) ABSTRACT

A method of determining a camshaft position. The method comprises determining temperatures, measuring camshaft deviations, and determining a camshaft deviation gradient. Embodiments of the invention may also take the form of a camshaft position temperature compensation system having a memory, a gradient processing module, a temperature sensor, a camshaft position sensor, and an approximation module.

25 Claims, 5 Drawing Sheets

METHOD AND SYSTEM FOR DETERMINING CAMSHAFT POSITION

BACKGROUND OF THE INVENTION

The present invention relates to a control system, and more particularly to a control system for an internal combustion engine.

Determining an accurate camshaft angular position or simply a camshaft position is an important factor in obtaining maximum torque from an engine equipped with a variable camshaft. Position sensors attached to the camshaft are typically used to measure the camshaft angular position. The measured camshaft position with respect to a crankshaft angular position is then calculated. However, manufacturing tolerances of the engine and of the sensors often lead to inaccurate measurement of the real camshaft position. This results in a camshaft measurement deviation.

As a consequence, different adaptation algorithms are employed to compensate for the camshaft deviation. Generally, these adaptation algorithms first lock the camshaft in a well-defined reference position, measure the camshaft position, and then compare the measured camshaft position with the well-defined reference position to obtain a measured camshaft deviation. The measured camshaft deviation is then stored in a memory. When an engine control system obtains a current camshaft position from the position sensors, the adaptation algorithm adds the measured camshaft deviation from the memory to the measured camshaft position to obtain a more accurate camshaft position. The correction of camshaft position based on these adaptation algorithms is generally time consuming, even under well-defined engine operating conditions, for example, 15 seconds during idle. Consequently, these adaptation algorithms are run only occasionally during a normal drive cycle.

In addition to manufacturing tolerances of engines and sensors, other factors such as operating temperature, also affect the accuracy of the camshaft measurement. Changes in operating temperature can cause engine expansion, and chain elongation, which, in turn, can increase camshaft measurement deviations. The inaccuracy due to the change of operating temperature also varies depending on the engine drive cycle. Using a temperature compensation look-up table, a rough estimate of the additional camshaft deviation is used to obtain the current camshaft position. However, the same engine and sensor manufacturing tolerances will also affect individual engines differently. Furthermore, the camshaft deviation due to the temperature changes also affects other diagnostic functions used by the engine control system, such as fault recognition. Thus, camshaft deviation caused by temperature changes also reduces fault recognition accuracy, which also results in a higher risk of detecting false errors and a lower detection rate of real faults.

SUMMARY OF THE INVENTION

Accordingly, there is a need for improved methods and systems for determining camshaft position. In one embodiment, the present invention provides a method of determining a camshaft position. The method includes determining a plurality of temperatures that includes a current temperature, measuring a camshaft deviation at each of the temperatures, determining a camshaft deviation gradient based on the temperatures, and updating the camshaft position based on the camshaft position measured at (a) the current temperature, (b) at least one of the camshaft deviations, (c) the camshaft deviation gradient, and (d) the current temperature.

In another embodiment, the invention provides a second method of determining a camshaft position. The method includes retrieving camshaft position data from a memory, determining a rate of change of camshaft position using the camshaft position data, approximating a camshaft deviation based on the rate of change of camshaft position, measuring a camshaft position at a current temperature, and updating the camshaft position based on the approximated camshaft deviation, and the current temperature.

In yet another embodiment, the present invention provides a camshaft position temperature compensation system. The system includes a memory that stores a plurality of camshaft positions, and a gradient processing module that is coupled to the memory. The gradient processing module determines a rate of change of camshaft position. The system also includes a temperature sensor that measures a current temperature, a camshaft position sensor that measures a camshaft position, and an approximation module coupled to the temperature sensor, the camshaft position sensor, and the gradient processing module. The approximation module approximates a camshaft position based on the current temperature, the current camshaft position, and the rate of change of camshaft position.

Other features and advantages of the invention will become apparent to those skilled in the art upon review of the following detailed description, claims, and drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. In addition, the terms "connected" and "coupled" and variations thereof are not restricted to physical or mechanical connections or couplings.

DETAILED DESCRIPTION

Figure 1:
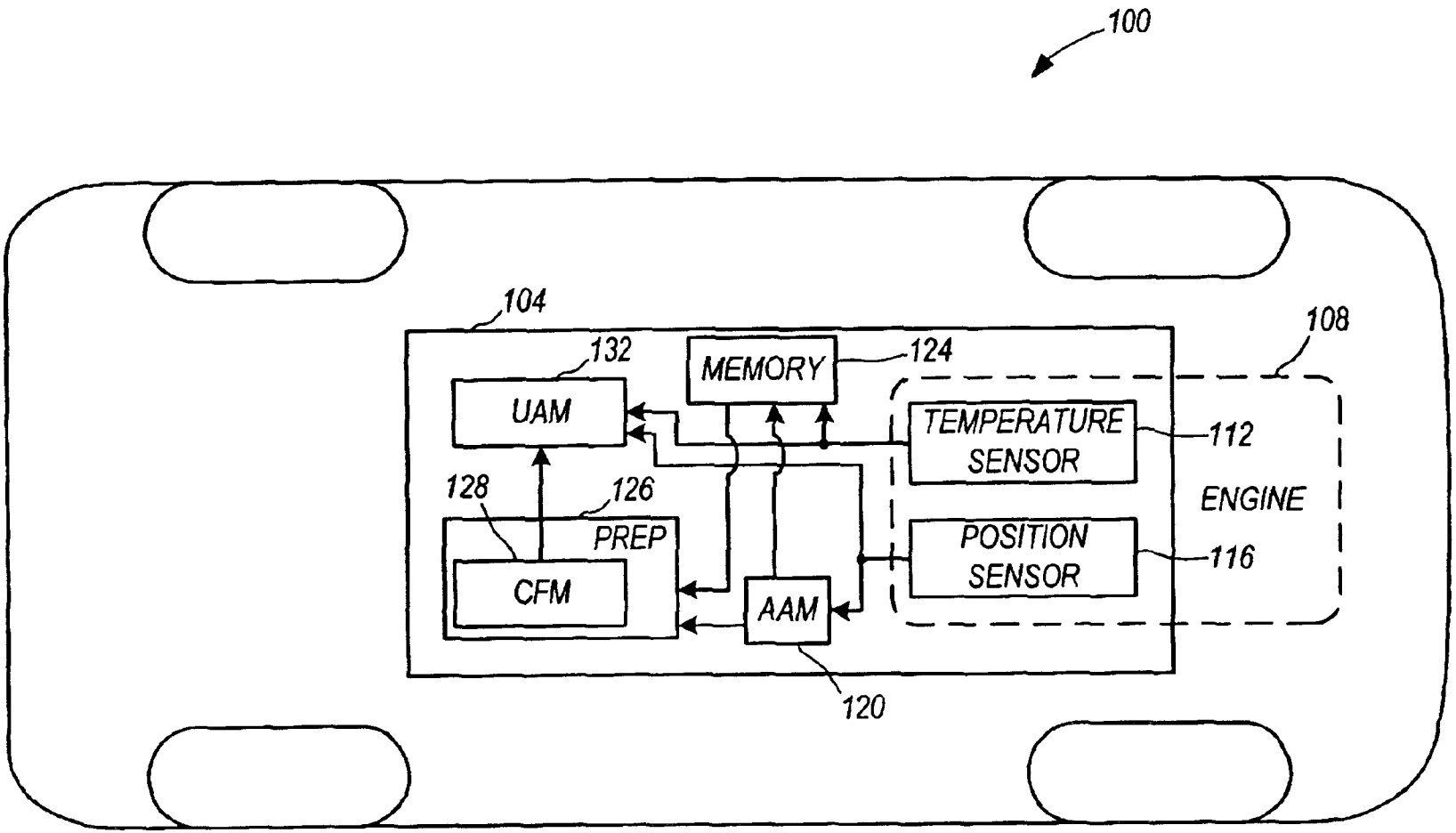
FIG. 1 shows a vehicle with a camshaft temperature compensation system of one embodiment of the invention.

FIG. 1 shows a vehicle 100 with a camshaft temperature compensation system 104. The vehicle 100 includes an engine 108, a temperature sensor 12 positioned to measure engine temperature, and a position sensor 116 also positioned to measure a camshaft position of the camshaft (not shown) of engine 108. Generally, the temperature sensor 112 is disposed to measure an engine oil temperature. However, other engine temperatures, such as the water or coolant temperature, can also be used. As noted, the position sensor 116 is generally positioned near the camshaft. Depending on the engine 108 used, the number of position sensors may be different. For example, there are four position sensors 116 in an engine with four camshafts. Therefore, the embodiment shown in FIG. 1 only illustrates an exemplary system.

The camshaft temperature compensation system 104 uses an adaptation algorithm module ("AAM") 120 to calculate a camshaft difference or camshaft deviation between a known or locked reference camshaft position and the measured camshaft position from the position sensor 116. For example, after the engine 108 is started, the AAM 120 receives a measured camshaft position from the position sensor 116. The AAM 120 then determines a first deviation ($D_1$) based on the difference between the known or locked reference camshaft position and the measured camshaft position. The first deviation ($D_1$) along with a first temperature ($T_1$) at which the camshaft position was measured by the temperature sensor 112, are sent to and stored in a memory 124 as a first set of camshaft position data. Similarly, a second set of camshaft position data (at a second time) including a second deviation ($D_2$) and a second temperature, ($T_2$) are also determined by the AAM 120, and stored in the memory 124. The number of camshaft position data sets collected and stored depends on the accuracy desired and the requirements of the vehicle 100. For example, in a typical application or implementation five or more sets of camshaft position data are collected during the warm up cycle of the engine.

Referring back to FIG. 1, the system 104 also includes a data preparation module ("PREP") 126. When the system 104 requests an update of the current camshaft position, the PREP 126 prepares the position data to be further processed by a curve fitting module ("CFM") 128. For example, the position data from the memory 124 can be prepared by the CFM 128 to generate a set of curve coefficients. Details of the processing performed by the PREP 126 and the CFM 128 will be described hereinafter. The system 104 also includes an updating and approximation module ("UAM") 132 coupled to the PREP 128. Together with the curve coefficients generated, a current temperature measured by the temperature sensor 112, a measured camshaft position measured by the position sensor 116, the UAM 132 then generates an updated camshaft position.

Figure 2:
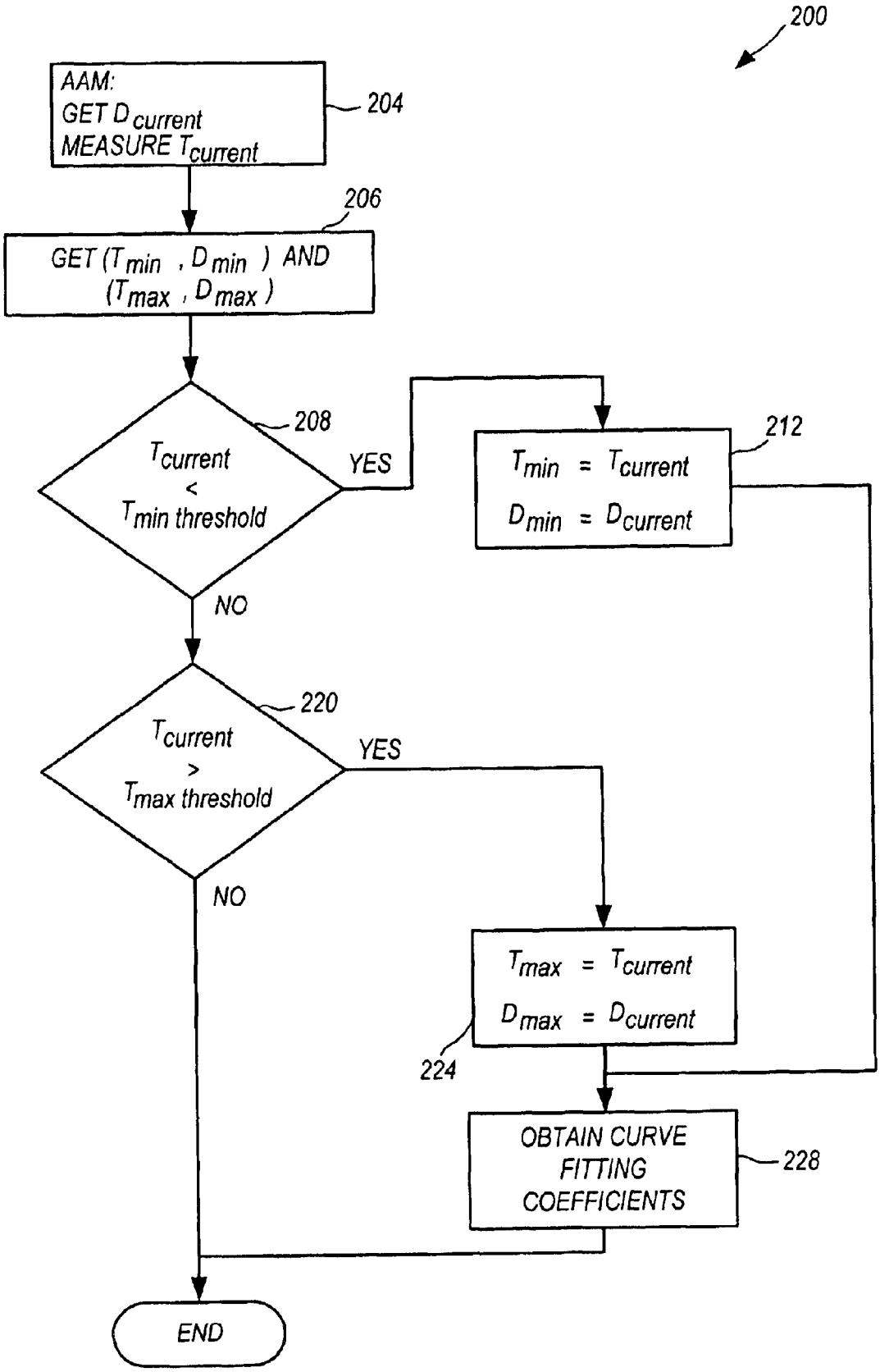
FIG. 2 is a data preparation flow chart used in one embodiment of the invention.

FIG. 2 shows a first flow chart 200 used in the PREP 126 (FIG. 1) according to the present invention. At block 204, a set of current position data including a current camshaft deviation ($D_{current}$) generated by the AAM 120 and a current temperature ($T_{current}$) (at which $D_{current}$ is measured) from the temperature sensor 112 is obtained. A set of pre-determined position data are then compared with the current position data subsequently. For example, at block 206, at least two sets of pre-determined position data measured prior to the current position data and stored in the memory 124 are retrieved. The two sets of pre-determined position data typically include a minimum deviation ($D_{min}$), a minimum temperature ($T_{min}$) at which $D_{min}$ is determined, a maximum deviation ($D_{min}$) and a maximum temperature ($T_{min}$) at which $D_{max}$ is measured. At block 208, $T_{current}$ is compared with $T_{min\ threshold}$. If $T_{current}$ is less than $T_{min\ threshold}$, $T_{min}$ is set to (or assigned to) $T_{current}$ and $D_{min}$ is set to $D_{current}$ at block 212. Otherwise, that is, when $T_{current}$ is at least equal to $T_{min\ threshold}$, $T_{current}$ is compared to $T_{min\ threshold}$ at block 220. If $T_{current}$ is greater than $T_{max}$ threshold, $T_{max}$ is set to (or assigned to) $T_{current}$, and $D_{max}$ is set to $D_{current}$ at block 224. Potentially, as a result, a new minimum set of position data or a new maximum set of position data is obtained after block 212 or block 224. Once the minimum or the maximum position data has been reset or determined, a plurality of curve fittings coefficients are generated. It should be understood that the minimum set of position data or the maximum set of position data can be repeatedly updated, or determined based on demand, and that multiple sets of minimum and maximum position data can also be obtained. A typical value of $T_{min\ threshold}$ is 40° C., and a typical value of $T_{max\ threshold}$ is 80° C.

At block 228, some curve fitting coefficients required by the CFM 128 are generated based on the pre-determined or the updated position data sets. More specifically, once the pre-determined minimum temperature ($T_{min}$) or the pre-determined maximum temperature ($T_{max}$) are updated, or when the pre-determined minimum camshaft ($D_{min}$) and the pre-determined maximum camshaft deviation ($D_{max}$) are updated, the pre-determined values are used to fit a curve by a numerical method. For example, the desired curve may be a first order curve, or a straight line, and the numerical method can be a linear interpolating polynomial. Other numerical methods may be used including a least square approximation technique with a regression line. For high accuracy, regression models such as a second or a third order regression can also be used.

When the desired regression curve is a linear interpolation, a camshaft deviation due to a change of temperature is determined at block 228 as follows. After the position data from the memory 124 has been retrieved and updated as described above, curve fitting coefficients such as a rate of change of camshaft position $$\left(\text{“}\frac{\partial D}{\partial T}\text{”}\right)$$

with respect to temperature changes using the camshaft position data is determined as follows:

$$\frac{\partial D}{\partial T} = \frac{D_{\max} - D_{\min}}{T_{\max} - T_{\min}}.$$

Figure 3:
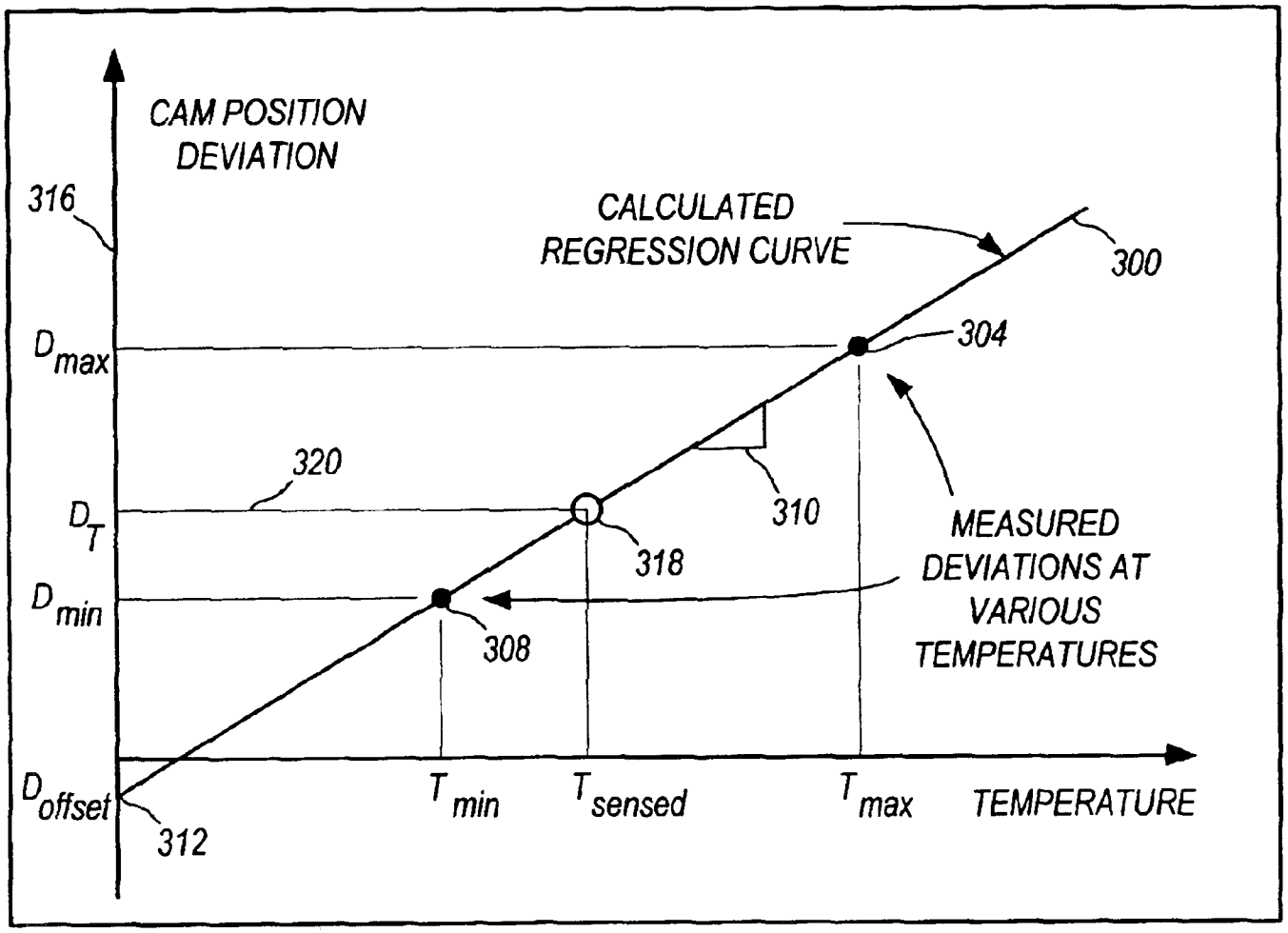
FIG. 3 shows a plot of camshaft deviations against temperature used in an embodiment of the invention.

That is, a first difference between $D_{max}$ and $D_{min}$, a second difference between $T_{max}$ and $T_{min}$, and a gradient from dividing the first difference by the second difference are generated at block 228. Using the generated gradient in the case of a linear interpolation, a deviation offset ($D_{offset}$) is also obtained at block 228. This may be better understood by reference to FIG. 3, which illustrates a deviation-temperature curve, a curve, or a line 300 crossing points ($T_{max}$, $D_{max}$) 304 and ($T_{min}$, $D_{min}$) 308, and having a gradient 310. The line 300 extends to an intercept at a point (0, $D_{offset}$) 312 on a deviation axis 316. The gradient $$\left(\frac{\partial D}{\partial T}\right)$$

310, and $D_{offset}$ 312, which constitute a set of curve fitting coefficients are obtained. The sets of curve fitting coefficients are then optionally weighted depending on different determining factors such as the rotational speed or velocity and the time the last set of curve fitting coefficients was generated.

Once the curve fitting coefficients such as the gradient $$\left(\frac{\partial D}{\partial T}\right)$$

Figure 4:
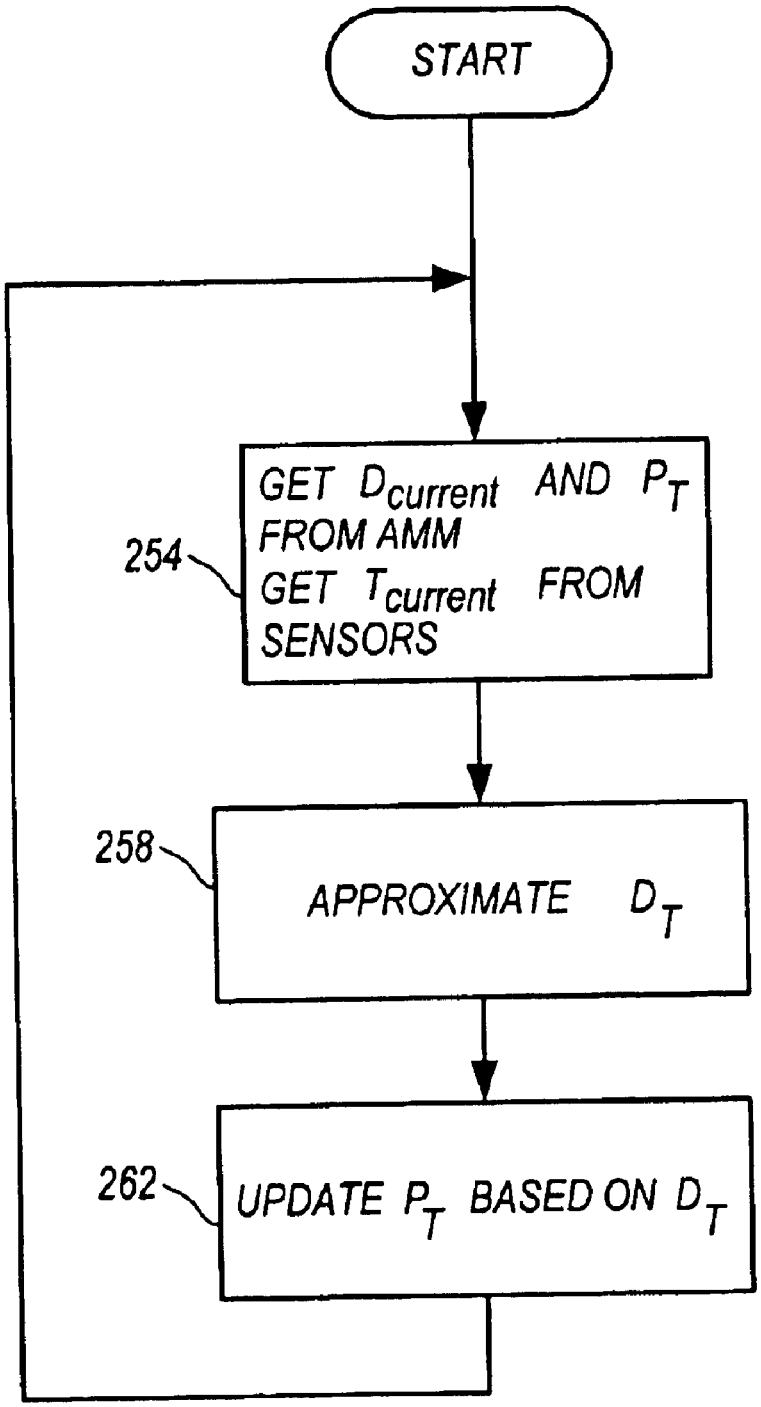
FIG. 4 is a flow chart illustrating updating and approximating a camshaft position according to one embodiment of the invention.

310, and $D_{offset}$ 312 have been determined, the camshaft position can be updated and approximated as shown in FIG. 4. Specifically, FIG. 4 shows a flow chart 250 of updating and approximating a camshaft position due to a change of temperature. When the system 104 requests a camshaft position update and approximation, the system 104 will also obtain a temperature reading ("$T_{sensed}$" or "7") from the temperature sensor 112, and a camshaft position ("$P_T$") reading from the AAM 120 or the position sensor 116, as shown in block 254. $P_T$ is either a manufacturing tolerance compensated camshaft position when obtained from the AAM 120, or a non-compensated position, or simply a sensed position when obtained from the position sensor 116. UAM 132 then reads the curve fitting coefficients from PREP 126, and approximates a camshaft deviation ("$D_T$") due to the change of temperature with the curve fitting coefficients, as shown in block 258. When a linear regression is used, the camshaft deviation due to the change of temperature is approximated as follows:

$$D_T = D_{offset} + \frac{\partial D}{\partial T} \cdot T_{sensed}.$$

That is, the deviation due to the sensed temperature ($T_{sensed}$) is equal to a sum of $D_{offset}$ 312 and the product between the gradient 310 and $T_{sensed}$. Alternatively, referring back to FIG. 3, when a camshaft deviation point ($T_{sensed}$, $D_T$) 318 is requested, $T_{sensed}$ is first sensed, and located on the curve 300. The corresponding deviation $D_T$ can also be determined from a line 320 normal to the deviation axis 316 and crossing the curve 300 at the temperature $T_{sensed}$. Once the camshaft deviation due to temperature change has been determined or approximated, the camshaft position, $P_T$, is updated by summing the measured $P_T$ and the approximated temperature deviation $D_T$, as shown in block 262 of FIG. 4.

Generally, when a camshaft deviation point ($T_{sensed}$, $D_T$) is requested, the $T_{sensed}$ is first sensed. The corresponding camshaft deviation is then obtained by plugging the sensed temperature $T_{sensed}$ into the curve that encompasses the curve fitting coefficients.

In an alternative embodiment, the measured deviations such as $D_{min}$, and $D_{max}$ are averaged over a number of times and temperatures, or filtered over several measurements. In yet another embodiment, a temperature threshold is used to set up the regressive curve. For example, the temperature threshold may require that an absolute difference between $T_{min}$ and $T_{max}$ is greater than a pre-determined minimum. In yet another example, the temperature threshold may require that an absolute difference between $T_{min}$ and $T_{max}$ is less than a predetermined maximum. In this way, the deviations produced by the system 100 will have a higher accuracy.

Once the temperature maximum and minimum, and the deviation maximum and minimum have been determined, a deviation threshold can be set up to validate the fault recognition. For example, when $D_T$ is beyond the deviation threshold developed, a fault recognition can be invalidated. Furthermore, with the line 300 (FIG. 3), a hypothetical deviation ($D_{HYPO}$) at an exemplary temperature can be determined. Once $D_{HYPO}$ has been determined, if $T_{sensed}$ does not exceed some pre-determined threshold, $D_T$ can be optionally set to $D_{HYPO}$ to reduce the systems response time. For example, when a hypothetical deviation is calculated at 20° C., a fault is detected only when $T_{sensed}$ is significantly higher than 20° C.

Figure 5:
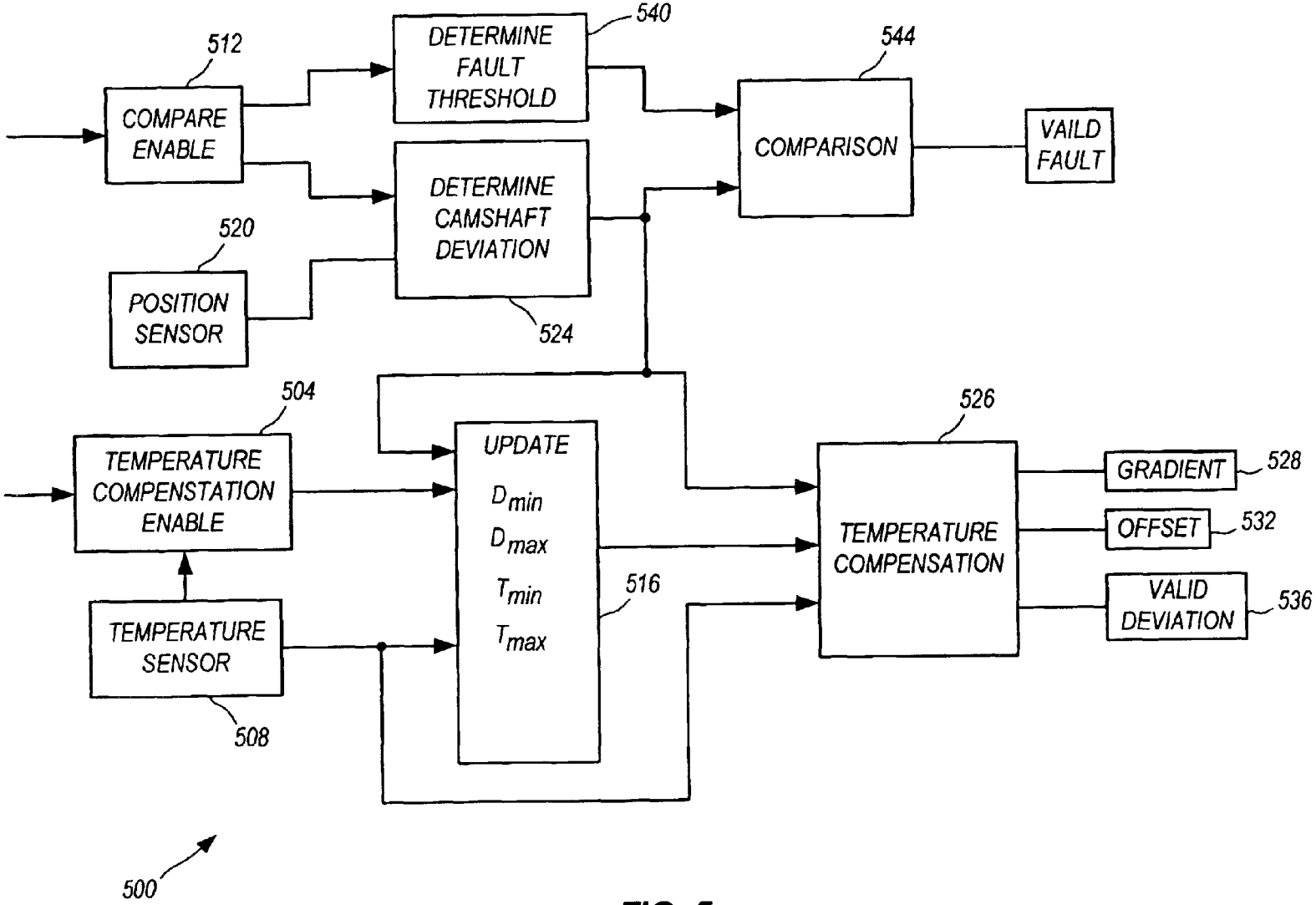
FIG. 5 illustrates an alternative embodiment of the invention.

FIG. 5 shows an alternative system 500 embodying the present invention. System 500 includes a temperature compensation enable 504 configured to receive a temperature reading from a temperature sensor 508 (or 112 of FIG. 1), and a fault validity enable 512. When the enable 504 is activated, the temperature reading is compared with an existing minimum temperature or an existing maximum temperature, as described in block 208 or block 220 of FIG. 2, respectively. If the existing temperature limits requires an update, the enable 504 will send an enable signal to an update module 516. Using a camshaft position reading from a camshaft position sensor 520, a camshaft deviation is determined at a deviation determination module 524. A temperature compensation module 526 then processes the determined deviation from module 524, the temperature reading from sensor 508, and the updated temperature limits, to generate a gradient 528 (310 of FIG. 3) and offset 532 (312 of FIG. 3) and a deviation validity 536. The deviation validity 536 from the temperature compensation module 526 then controls whether the updated camshaft position, as determined in block 262 (of FIG. 2) (for example), should be released.

The system 500 also includes a fault threshold module 540. When the enable 512 is activated, the fault threshold module 540 sets up a deviation threshold in which fault recognition is considered faulty. A comparison module 544 then compares the deviation reading from module 524 with the threshold. A fault validity is generated based on the comparison results. For example, a fault is valid when the deviation is within the threshold.

For ideal engine operation, the deviation should be as small as possible. Generally, the smaller the deviation, the greater or higher the alignment is between the camshaft and crankshaft. The alignment is also sometimes referred to as a timing of opening and closing of valves relative to a piston position. As described earlier, many factors affect alignment deviation ($D_{current}$). These factors include actual deviations from manufacturing tolerances and increasing wear, virtual deviations such as sensor tolerances, mounting mistakes such as misalignment of the belt or chain that drives the camshaft from a crank, and temperature effects due to sensor characteristic or different expansion within the engine 108.

Diagnostic functions that check errors such as mounting mistakes generally compare $D_{current}$ with a diagnostic threshold $D_{diagnosis}$ to determine if, for example, the mounting mistakes are acceptable. If $D_{current}$ is greater than $D_{diagnosis}$, a fault code is generated. To accurately generate a fault code, tolerance factors such as manufacturing, aging, and temperature are considered in determining $D_{diagnosis}$. As a result, $D_T$ as determined earlier can be used to compensate for the effect of the engine temperature of the engine 108. Specifically, $D_T$ can be used to calculate $D_{HYPO}$ at a defined temperature, for example 20° C. Thereafter, $D_{HYPO}$ at the defined temperature can be compared to $D_{diagnosis}$ at block 544. In that way, the diagnostic threshold ($D_{diagnosis}$) can be lowered, and therefore the fault detection can be improved.

As should be apparent to one of ordinary skill in the art, the systems shown in FIGS. 1 and 5 are models of actual systems. In fact, the system shown in FIG. 5 is based on a model made using ASCET-SD modeling simulation software, which will automatically generate software code, and documentation based on the logical constructs created by the designer. Many of the modules and logical structures described are capable of being implemented in software executed by a microprocessor or a similar device or of being implemented in hardware using a variety of components including, for example, application specific integrated circuits ("ASICs"). Thus, the claims should not be limited to any specific hardware or software implementation or combination of software or hardware.

Various features and advantages of the invention are set forth in the following claims.

What is claimed is:

1. A camshaft position temperature compensation system comprising:

a curve fitting module configured to determine a plurality of camshaft deviation temperature curve coefficients;

a temperature sensor configured to measure a plurality of temperatures including a current temperature;

a camshaft position sensor configured to measure a plurality of camshaft positions including a current camshaft position; and an updating module coupled to the temperature sensor, the camshaft position sensor, and the curve fitting module, configured to update a camshaft position based on the current temperature, the current camshaft position, and the camshaft deviation temperature curve coefficients.

2. The system of claim 1, further comprising a memory coupled to the curve fitting module, and configured to store camshaft position data.

3. The system of claim 1, wherein the curve fitting module approximates the deviation temperature curve coefficients with a numerical method.

4. The system of claim 3, wherein the numerical method is a linear interpolating polynomial.

5. The system of claim 1, wherein the temperature comprises at least one of an oil temperature, a coolant temperature, and a water temperature.

6. The system of claim 1 wherein the updating module plugs the current temperature into the camshaft deviation temperature curve coefficients to obtain a current camshaft deviation, and adds the current camshaft deviation to the current camshaft position thereby updating the camshaft position.

7. The system of claim 1, wherein the updating module determines a current camshaft deviation, multiplies the camshaft deviation gradient by the current temperature to obtain a deviation product, adds the deviation product to the current camshaft deviation to obtain a temperature compensated deviation, and adds the temperature compensated deviation to the current camshaft deviation thereby updating the camshaft position.

8. The system of claim 1, wherein the camshaft deviation temperature comprises a camshaft deviation gradient, and a camshaft deviation intercept.

9. A method of determining a camshaft position comprising:

determining a plurality of temperatures including a current temperature;

measuring a camshaft deviation at each of the temperatures;

determining a camshaft deviation gradient based on the temperatures; and updating the camshaft position based on the camshaft position measured at the current temperature, at least one of the camshaft deviations, the camshaft deviation gradient, and the current temperature.

10. The method of claim 1, wherein the temperatures further comprise at least one of an oil temperature, a coolant temperature, and a water temperature.

11. The method of claim 1, wherein determining the camshaft deviation gradient further comprises:

determining a temperature difference between two temperatures;

determining two camshaft deviations at the two temperatures;

determining a camshaft difference between the two camshaft deviations; and determining the camshaft difference by the temperature difference, thereby generating the camshaft deviation gradient.

12. The method of claim 11, wherein determining the two camshaft deviations comprises:

sensing a first camshaft position at the first temperature;

comparing the first camshaft position with a first referenced position, thereby generating the first camshaft deviation;

sensing a second camshaft position at the second temperature; and comparing the second camshaft position with a second referenced position.

13. The method of claim 1, wherein updating the camshaft position further comprises:

determining a camshaft deviation intercept using the camshaft deviation, the temperature, and the camshaft deviation gradient;

determining a deviation product between the camshaft deviation gradient and the current temperature; and summing the camshaft deviation and the deviation product.

14. The method of claim 1, wherein determining a camshaft deviation gradient further comprises approximating a deviation temperature curve using the temperatures and the camshaft deviations.

15. The method of claim 14, wherein the deviation temperature curve comprises a linear regressive curve.

16. The method of claim 1, wherein determining the temperatures comprises:

retrieving a maximum temperature and a minimum temperature;

assigning a new minimum temperature when the minimum temperature is greater than the current temperature; and assigning a new maximum temperature when the maximum temperature is less than the current temperature.

17. A method of determining a camshaft position comprising:

retrieving camshaft position data from a memory;

determining a camshaft deviation temperature curve using the camshaft position data;

measuring a camshaft position at a current temperature;

approximating a camshaft deviation with the camshaft deviation temperature curve and the current temperature; and updating the camshaft position based on the approximated camshaft deviation.

18. The method of claim 17, wherein the camshaft position data comprises a plurality of temperatures and a plurality of corresponding camshaft deviations.

19. The method of claim 18, further comprising:

measuring a camshaft position for each temperature; and comparing the camshaft position with a referenced camshaft position to generate a camshaft deviation at each temperature.

20. The method of claim 17, further comprising determining a rate of change of camshaft position data.

21. The method of claim 20, further comprising:

determining a camshaft deviation intercept using the camshaft position data;

determining a deviation product between the rate of change of camshaft position data and the current temperature; and summing the camshaft deviation intercept and the camshaft deviation intercept.

22. The method of claim 17, wherein the camshaft deviation temperature curve comprises a linear regression curve.

23. The method of claim 17, wherein determining the camshaft deviation temperature curve further comprises numerically approximating a curve through the camshaft position data.

24. The method of claim 17, wherein approximating a camshaft deviation comprises plugging the current temperature into the camshaft deviation temperature curve.

25. The method of claim 17, further comprising:

measuring a camshaft position at a temperature; and comparing the camshaft position with a referenced camshaft position at the temperature, thus forming camshaft position data comprising a camshaft deviation for each temperature.

* * * * *